US007938306B2

(12) United States Patent
Sugihara et al.

(10) Patent No.: US 7,938,306 B2
(45) Date of Patent: May 10, 2011

(54) STAPLER CLINCHER MECHANISM

(75) Inventors: Shinpei Sugihara, Chuo-ku (JP); Hiroshi Udagawa, Tokyo (JP)

(73) Assignee: Max Co., Ltd., Tokyo (JP)

( * ) Notice: Subject to any disclaimer, the term of this patent is extended or adjusted under 35 U.S.C. 154(b) by 25 days.

(21) Appl. No.: 12/580,792

(22) Filed: Oct. 16, 2009

(65) Prior Publication Data

US 2010/0096430 A1 Apr. 22, 2010

(30) Foreign Application Priority Data

Oct. 17, 2008 (JP) ..... 2008-268153
Aug. 29, 2009 (JP) ..... 2009-199098

(51) Int. Cl.
*B25C 5/02* (2006.01)
*B27F 7/00* (2006.01)

(52) U.S. Cl. ..... 227/155; 227/131

(58) Field of Classification Search ..... 227/131, 227/154, 155, 82, 88, 79, 119, 134
See application file for complete search history.

(56) References Cited

U.S. PATENT DOCUMENTS 4,358,040 A * 11/1982 Stokes ..... 227/5
4,593,847 A * 6/1986 Hagemann ..... 227/155
5,516,025 A * 5/1996 Eriksson ..... 227/155
5,678,745 A * 10/1997 Yoshie ..... 227/4
6,036,074 A * 3/2000 Manabe ..... 227/155
6,056,183 A * 5/2000 Tanabe ..... 227/155
6,250,531 B1 * 6/2001 Yagi ..... 227/79
7,014,091 B2 * 3/2006 Mochizuki ..... 227/155
7,228,999 B2 * 6/2007 Oide et al. ..... 227/155
7,311,236 B2 * 12/2007 Smith et al. ..... 227/131

FOREIGN PATENT DOCUMENTS

JP 11-28682 2/1999
JP 2004-276196 10/2004

* cited by examiner

*Primary Examiner* — Scott A. Smith
(74) *Attorney, Agent, or Firm* — Drinker Biddle & Reath LLP

(57) ABSTRACT

A stapler clincher mechanism which bends two leg portions of a staple struck and penetrated through papers by a staple driving unit, includes: two first clinchers respectively disposed downwardly of the two leg portions of the staple and respectively including guide inclined surfaces which guides the two leg portions in such a manner that the two leg portions are curved inwardly; a second clincher interposed between the two first clinchers and including a projection portion which presses leading ends of the two curved leg portions toward a paper surface of the papers; and a drive mechanism, after the two leg portions of the staple are curved by the guide inclined surfaces, which retreats the first clinchers along the paper surface and moves the second clincher toward the paper surface.

8 Claims, 16 Drawing Sheets

STAPLER CLINCHER MECHANISM

This application claims priority from Japanese Patent Application No. 2008-268153, filed on Oct. 17, 2008, and Japanese Patent Application No. 2009-199098, filed on Aug. 29, 2009, the entire contents of which are hereby incorporated by reference.

FIELD OF THE INVENTION

The present invention relates to a stapler clincher mechanism which, after clinching two leg portions of a staple penetrated through papers, binds together the papers in such a manner that leading ends of the staple leg portions are prevented from floating up from a surface of the papers.

DESCRIPTION OF RELATED ART

Generally, when binding together papers using a stapler, two leg portions of a staple penetrated through the papers are bent flat and clinched.

When binding together central portions of the paper surfaces of printings such as brochures or catalogs, in the flat clinching method, since the papers are bound in such a manner that the leg portions of a staple are abutted on the paper surface, there is a possibility that leading ends of the staple leg portions can float up from the paper surface. If the leading ends of the staple leg portions float up even slightly, when a user turns over the pages of the papers, the fingers of the user can be caught by the leg portions of the staple, which can make the user feel troublesome.

In this case, instead of the flat clinching method, preferably, there may be used a so called eyeglass clinching method in which the leg portions of the staple are bent in an arc shape, because the leading ends of the staple leg portions face the paper surface.

Japanese Patent Publication 2004-276196

Japanese Patent Publication Hei-11-28682

However, since a clinching groove used in the eyeglass clinching method is formed in a fixed manner, the clinching groove is able to correspond only to a staple having a fixed crown width. Since the papers such as in-house newsletters, brochures and catalogs often vary in size, in order to make the papers look attractive, in some cases, the crown width of the staple must be changed to the sizes of the papers. Also, when the crown width of the staple is set constant, there is raised a great difference in the after-bound staple leg length between thin and thick papers, which has an ill influence on the appearance of the papers. Therefore, it is possible to employ a method which changes the crown width of the staple according to the thin and thick papers to thereby adjust the staple leg length. However, when the method is able to correspond only to one kind of crown width, different clinchers must be prepared whenever the crown width of the stapler differs, resulting in the troublesome binding operation.

SUMMARY OF INVENTION

Illustrative aspects of the present invention provide a stapler clinching mechanism which can carry out a binding operation even when using staples different in a crown width from each other.

According to a first aspect of the invention, a stapler clincher mechanism which bends two leg portions of a staple struck and penetrated through papers by a staple driving unit, is provided with: two first clinchers respectively disposed downwardly of the two leg portions of the staple and respectively including guide inclined surfaces which guides the two leg portions in such a manner that the two leg portions are curved inwardly; a second clincher interposed between the two first clinchers and including a projection portion which presses leading ends of the two curved leg portions toward a paper surface of the papers; and a drive mechanism, after the two leg portions of the staple are curved by the guide inclined surfaces, which retreats the first clinchers along the paper surface and moves the second clincher toward the paper surface.

Other aspects and advantages of the invention will be apparent from the following description, the drawings and the claims.

DETAILED DESCRIPTION OF EXEMPLARY EMBODIMENTS

Figure 1:
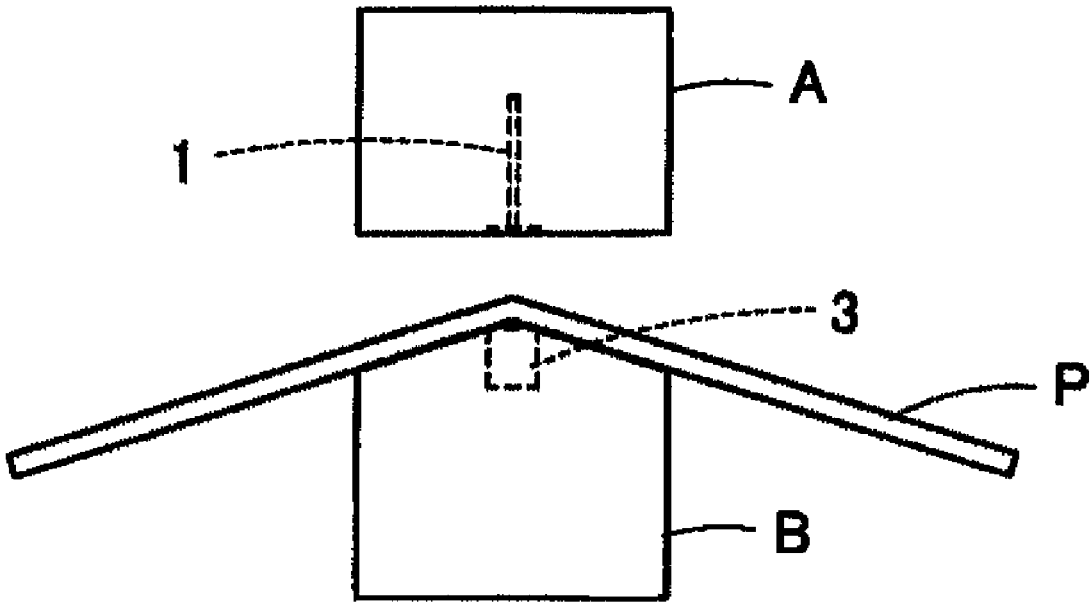
FIG. 1 is a general view of a stapler according to the invention.

FIG. 1 is a general view of a stapler including a clincher mechanism according to exemplary embodiments of the invention. This stapler includes a driving device A having a driver 1 for striking out a staple S, and a binding device B for bending the struck-out staple for binding, while the two devices A and B are disposed up and down. Papers P such as brochures or catalogs are interposed between the driving device A and binding device B, a staple is struck into a central portion of the papers P using the driver 1 of the driving device A, and two leg portions of the staple penetrated through the papers P are bent using the clincher mechanism 3 of the binding device B for binding together the papers P.

Figure 2:
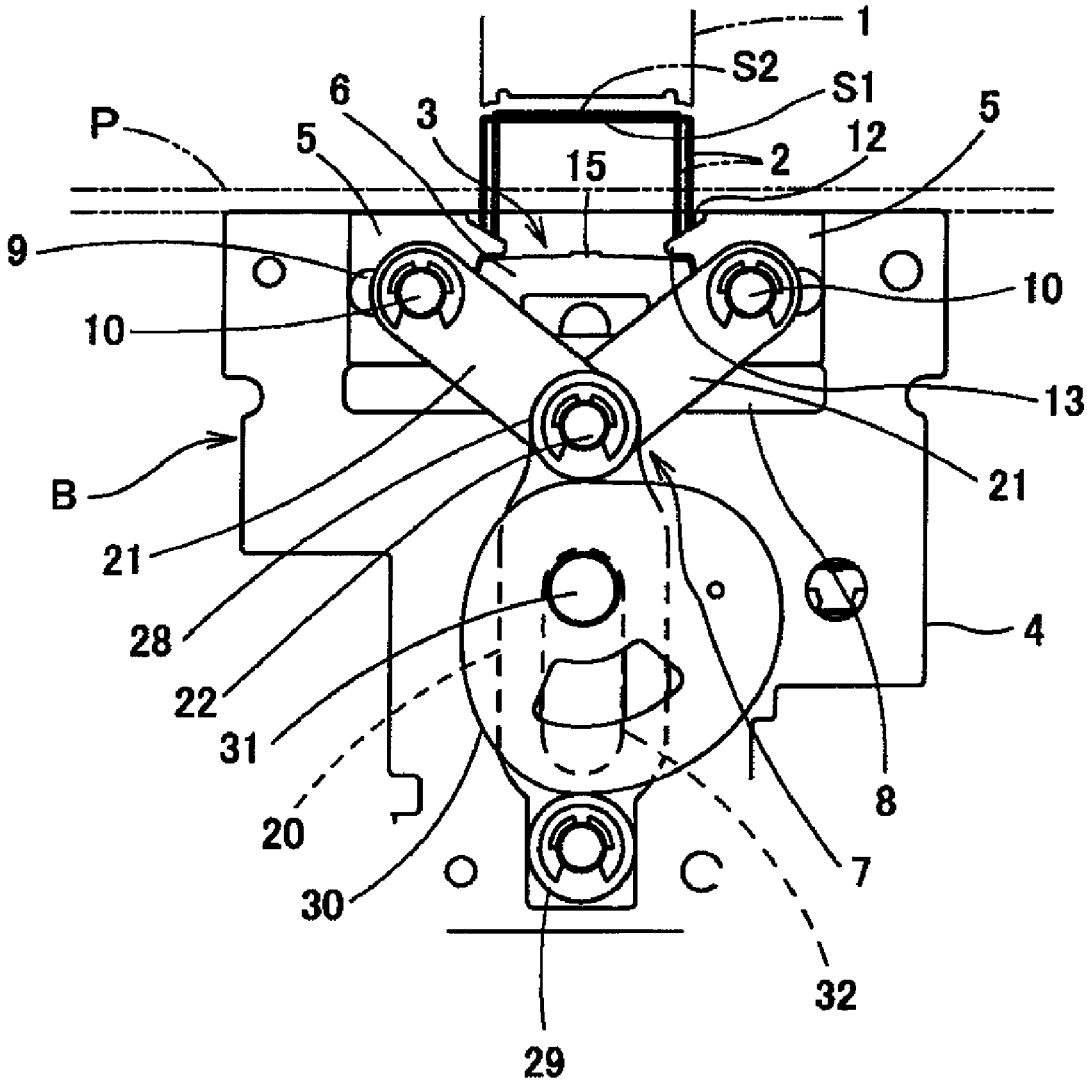
FIG. 2 is a front view of the whole of a clincher mechanism of the stapler according to a first exemplary embodiment of the invention.
Figure 3:
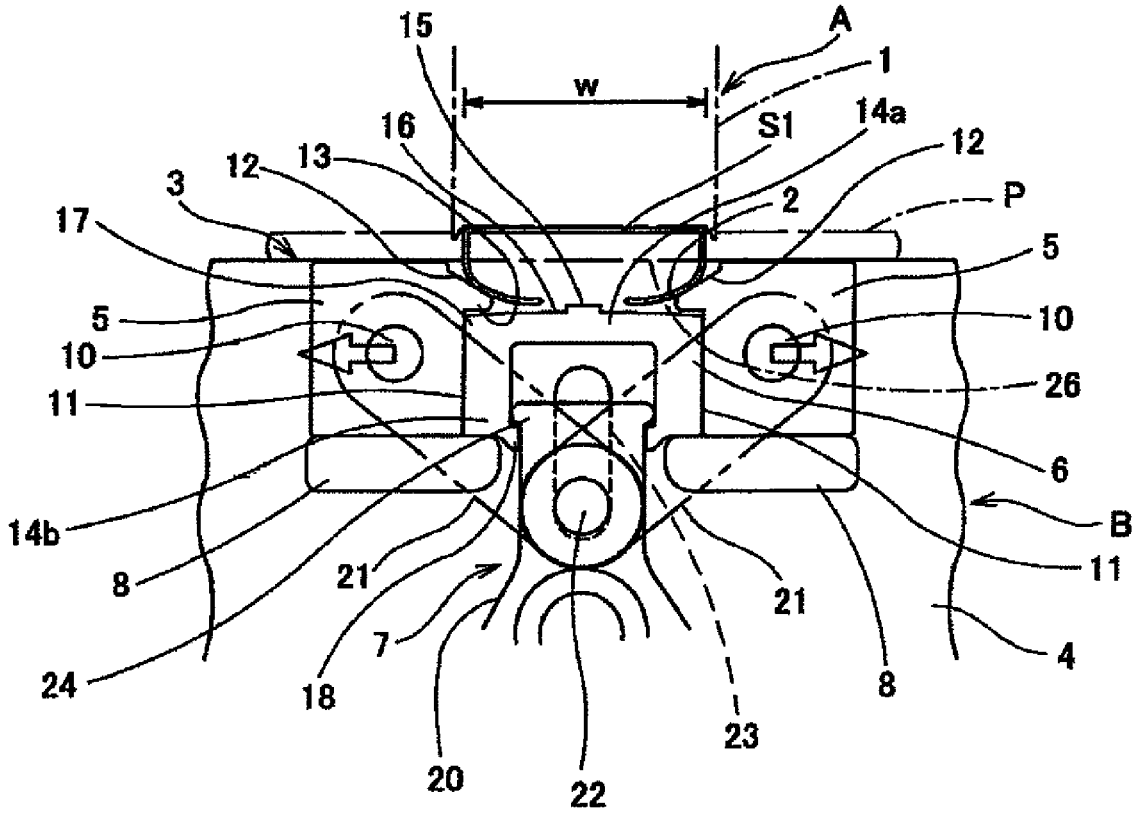
FIG. 3 is a front view of main portions of the clincher mechanism according to the first exemplary embodiment.

FIGS. 2 and 3 respectively show the clincher mechanism 3 of the binding device B according to a first exemplary embodiment. The clincher mechanism 3 is held inside a pair of front and rear plate-shaped holders 4 respectively provided in an upper binding portion of the binding device B, and is used to bend two leg portions 2 of the respective staples S1 (and S2) that have been struck and penetrated through the papers P by the driver 1. The clincher mechanism 3 includes a pair of first clinchers 5 arranged right and left, a second clincher 6 upwardly of and between the two first clinchers 5, a drive mechanism 7 for driving the first clinchers 5 and second clincher 6. Here, the papers P are to be placed on the upper surfaces of the plate-shaped holders 4.

The two first clinchers 5 are respectively a substantially square-plate-shaped member which is disposed below the two leg portions 2 of the staple S1 (S2). The first clinchers 5 are respectively supported on a support wall 8 fixed inside the plate-shaped holders 4, they include shaft members 10 respectively disposed in the center portions thereof, and the shaft members 10 are engaged with oblong elongated holes 9 respectively formed in their associated plate-shaped holders 4, whereby the first clinchers 5 can be slid in the right and left direction along the elongated holes 9. In the upper end portions of the mutually facing opposed edges 11 (see FIG. 3) of the first clinchers 5, there are formed guide inclined surfaces 12 which are used to guide the two leg portions 2 of the staple S1 (S2). The guide inclined surfaces 12 guide the two leg portions 2 such that the two leg portions 2 are curved inward; the guide inclined surfaces 12 are mutually inclined downward toward the center of the clincher mechanism 3; and, on the lower end portions of the guide inclined surfaces 12, there provided projecting portions 13 which respectively project from their associated opposed edges 11.

The guide inclined surfaces 12 of the first clinchers 5 are respectively formed to have such a size as can guide the leg portions of the two kinds of staples S1 and S2 which are different in the crown width w from each other (see FIG. 3).

The second clincher 6, as mainly shown in FIG. 3, is a gate-like plate-shaped member which includes a center piece 14*a* and two side pieces 14*b* respectively disposed on both sides of the center piece 14*a*; and, the second clincher 6 is interposed between the two first clinchers 5 in such a manner that it can be moved in the vertical direction. An upper end face (the leading end face which is disposed opposed to the surface of the papers P in the binding portion) 16 of the second clincher 6 is formed such that it descends outwardly right and left from a projection portion 15 provided on the central portion of the second clincher 6; and, outside corner portions 17 of the upper end face 16 are disposed such that they can be respectively engaged with the lower surfaces of the lower end projecting portions 13 of the guide inclined surfaces 12 of the first clinchers 5. Also, on lower end inner portions of the two side pieces 14*b* of the second clincher 6, there are provided two tongue pieces 18 respectively projecting toward the central side of the second clincher 6.

The drive mechanism 7, as shown in FIG. 2, includes: a drive link 20 disposed in the central portion of the drive mechanism 7; a pair of toggle links 21 which are respectively pivotally mounted on a support shaft 22 disposed upwardly of the drive link 20; and, a cam 30 interposed between two rollers 28 and 29 respectively provided on the upper and lower portions of the drive link 20. A rotation shaft 31 of the cam 30 is provided at a position which is shifted upwardly of the center of the cam 30, and the rotation shaft 31 is engaged with an elongated hole 32 formed long in the vertical direction in the drive link 20. And, upper and lower ends of the cam 30 are respectively formed such that they can be engaged with the outer peripheral surfaces of the rollers 28 and 29. Owing to this structure, when the cam 30 is rotated half, the cam 30 pushes up the upper roller 28 to thereby open the toggle links 21; and, when the cam 30 is rotated another half, the cam 30 pushes down the lower roller 29 to thereby close the toggle links 21. The upper roller 28 is rotatably supported on the support shaft 22. Here, the rotation shaft 31 of the cam 30 is operatively linked with an electric motor through a reduction gear (not shown).

Also, as shown in FIG. 3, the support shaft 22 of the drive link 20 is engaged with the paired front and back plate-shaped holders 4 in such a manner that the support shaft 22 can be moved in the vertical direction along elongated holes 23 which are respectively so formed in the holders 4 as to extend in the vertical direction. The upper end of the drive link 20 is disposed such that it can be engaged with the lower surface of the center piece 14*a* of the second clincher 6. On the two sides of the upper end of the drive link 20, there are provided projecting portions 24 respectively. When the drive link 20 moves up and down, the projecting portions 24 are allowed to slide along the inner surfaces of the two leg portions (two side pieces 14*b*) of the second clincher 6. Also, one-side ends of the toggle links 21 are pivotally mounted on the support shaft 22, whereas the other ends thereof are pivotally mounted on the shaft members 10 of the two first clinchers 5 respectively.

Next, description will be given below of the operation of the above-structured clincher mechanism 3 with reference to a staple S1 having a large crown width w (the leg portions 2 thereof are short) and a staple S2 having a small crown width w (the leg portions thereof are long).

Figure 4:
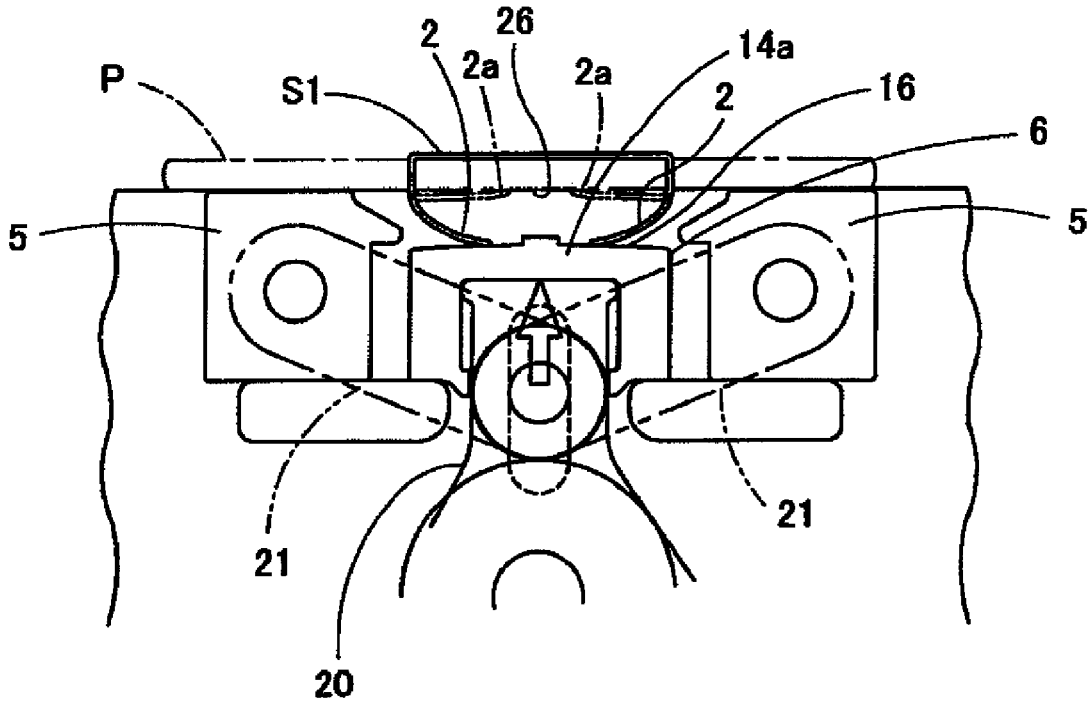
FIG. 4 is an explanatory view of the operation of the clincher mechanism according to the first exemplary embodiment.
Figure 5:
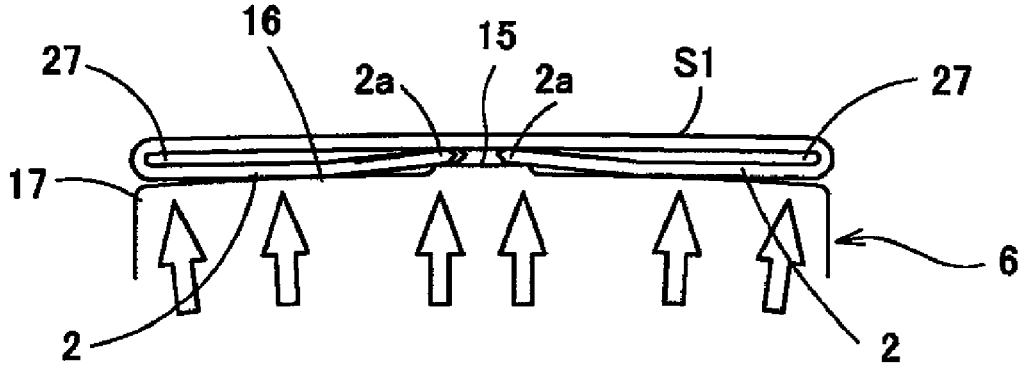
FIG. 5 is an explanatory view of the operation of a second clincher according to the first exemplary embodiment.

Firstly, to bind together the papers P using the staple S1 having a large crown width, as shown in FIG. 3, when the staple S1 is struck into the central portion of the papers P by the driver 1 of the driving device A, the two leg portions 2 of the staple S1 are penetrated through the papers P. The thus penetrated leg portions 2 are butted against the guide inclined surfaces 12 of the first clinchers 5 and are thereby curved inwardly. When the driver 1 reaches the bottom dead center, the drive mechanism 7 is operated to thereby move the drive link 20 upwardly. As a result of this, since the toggle links 21 are spread outwardly, the first clinchers 5 are operated such that they move away from each other in their respective retreat directions along a paper surface 26 of the papers P as shown by arrow marks in FIG. 3. When the first clinchers 5 move away from each other, as shown in FIG. 4, between the first clinchers 5, there is formed a space where the second clincher 6 is allowed to move upwardly and, at the same time, the upper end of the drive link 20 is engaged with the lower end of the center piece 14*a* of the second clincher 6, whereby the second clincher 6 moves upwardly toward the paper surface 26 of the papers P. Then, the upper end face 16 of the second clincher 6 is engaged with the curved two leg portions 2 to thereby press and bend the leg portions 2 toward the paper surface 26 and, as shown in FIG. 5 and by two-dot chained lines in FIG. 4, leading ends 2*a* of the thus-bent two leg portions 2 are extended above the projection portion 15, whereby the projection portion 15 presses the leading end sides of the two leg portions 2 further toward the paper surface 26 of the papers P. As a result of this, the leading ends 2*a* of the two leg portions 2 of the staple S1 are crushed and are thereby firmly pressed against the paper surface 26.

Here, when the two leg portions 2 of the staple S1 are pressed by the second clincher 6, if they are pressed parallel to the paper surface, the staple S1 is made flat. However, since the upper end face of the second clincher 6 is formed such that it descends toward the two sides of the projection portion 15, when the two leg portions 2 of the staple S1 are pressed by the second clincher 6, the pressing force acts to go outwardly as shown by arrow marks in FIG. 5, whereby the two leg portions 2 are bent in such a manner that there can be formed spaces 27 respectively between the turned portions of the base portions of the two leg portions 2. Therefore, as shown by the two-dot chained lines in FIG. 4, only the leading ends 2*a* of the two leg portions 2 are pressed against the paper surface 26 in such a manner that the leading ends 2*a* cuts into the paper surface 26.

In the above-mentioned manner, the leading ends 2*a* of the two leg portions 2 of the staple S1 are firmly pressed against the paper surface 26 by the second clincher 6. The leading ends 2*a* of the staple S1 is kept in a state where it faces the paper surface 26. This can prevent the leading ends 2*a* of the leg portions 2 from floating up from the paper surface 26.

Figure 6:
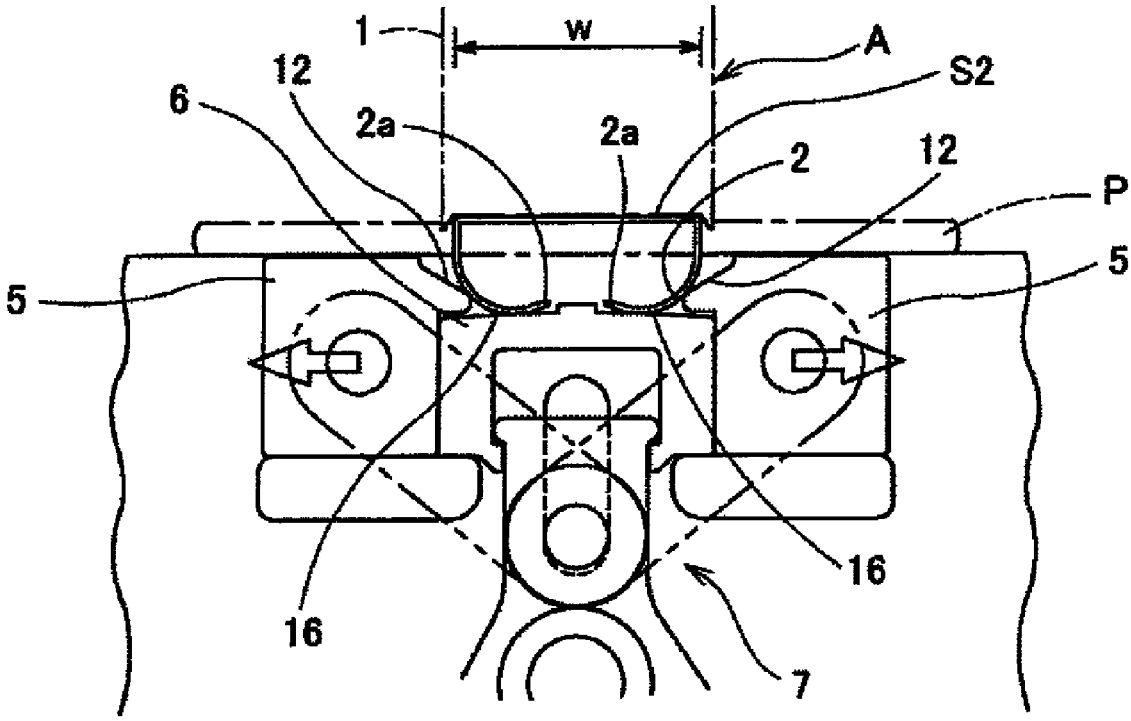
FIG. 6 is an explanatory view of a bending operation in which a staple having a small crown width is curved and bent using the clincher mechanism according to the first exemplary embodiment.
Figure 7:
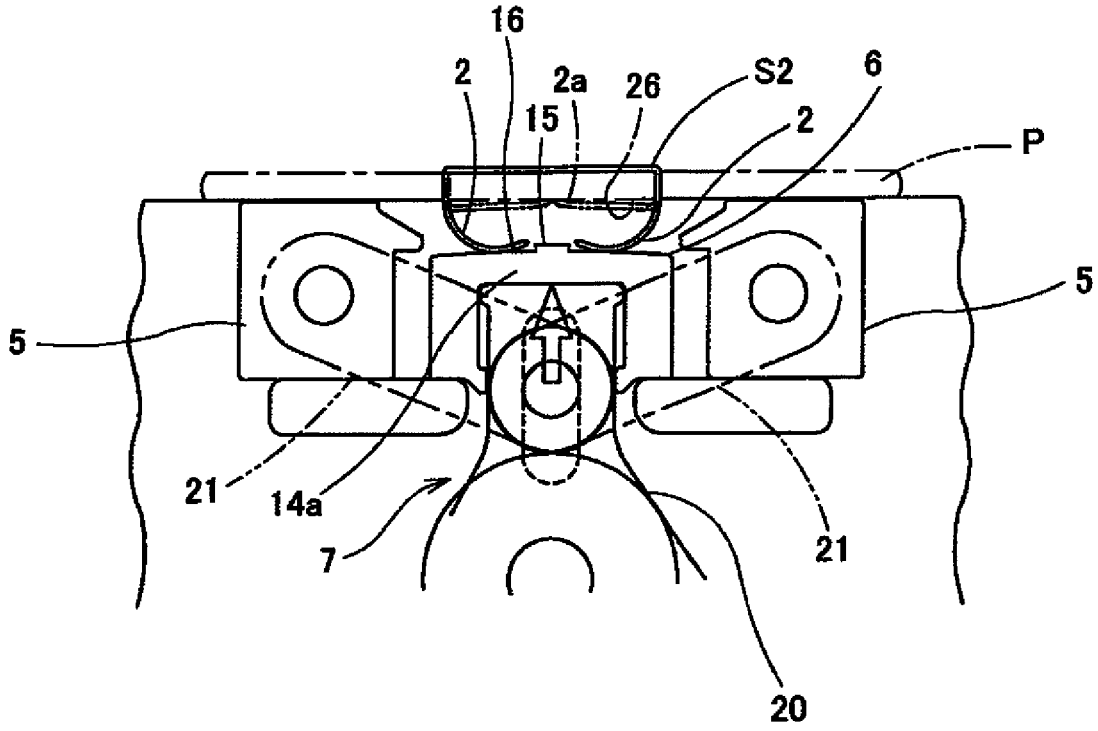
FIG. 7 is an explanatory view of the operation of the clincher mechanism according to the first exemplary embodiment.

Next, as shown in FIG. 6, to bind the binding-receiving papers P using the staple S2 having a small crown width w, when the staple S2 is struck into the central portion of the papers P by the driver 1 of the driving device A, the two leg portions 2 of the staple S2 are penetrated through the papers P. The thus penetrated leg portions 2 are butted against the guide inclined surfaces 12 of the two first clinchers 5 and are thereby curved inwardly. Since the distance between the two leg portions 2 of the staple S2 is relatively small, the leading ends 2*a* of the two leg portions 2 are engaged with the lower portions of the guide inclined surfaces 12 and thus cannot be curved sufficiently; however, the leading ends 2*a* of the two leg portions 2 are further butted against the upper end face 16 of the second clincher 6 and are then guided by the upper end face 16 in such a manner that they are curved further. And, when the driver 1 reaches the bottom dead center, the drive mechanism 7 is operated to thereby move the drive link 20 upwardly. Thus, the toggle links 21 are spread outwardly, whereby the first clinchers 5 are allowed to operate in such a manner that the first clinchers 5 move away from each other along the paper surface 26 in their respective retreat directions. When the first clinchers 5 move away from each other, between the first clinchers 5, there is formed a space where the second clincher 6 is allowed to move upwardly and, at the same time, as shown in FIG. 7, the upper end of the drive link 20 is engaged with the lower end of the upper piece 14*a* of the second clincher 6, whereby the second clincher 6 is allowed to move upwardly toward the paper surface 26. In this case, the upper end face 16 of the second clincher 6 is engaged with the curved two leg portions 2 to thereby press and bend the leg portions 2 toward the paper surface 26; and, since the leading ends 2*a* of the thus bent two leg portions 2 are extended above the projection portion 15, the projection portion 15 is allowed to further press the leading end sides of the curved two leg portions 2 toward the paper surface 26 of the papers P. Thus, the leading ends 2*a* of the two leg portions 2 of the staple S2 are crushed as shown by a two-dot chained line in FIG. 7 and are thereby firmly pressed against the paper surface 26.

Here, in this case as well, since the upper end face of the second clincher 6 is formed such that it descends toward the two sides of the projection portion 15, similarly to the case shown in FIG. 5, when the two leg portions 2 of the staple S2 are pressed using the second clincher 6, the two leg portions 2 are bent in such a manner that there can be formed spaces 27 between the turned portions of the base portions of the two leg portions 2, whereby only the leading ends 2*a* of the two leg portions 2 are pressed against the paper surface 26 in such a manner that the leading ends 2*a* cut into the paper surface 26.

In the above-mentioned manner, the leading ends 2*a* of the two leg portions 2 of the staple S2 are firmly pressed against the paper surface 26 by the second clincher 6. Since the leading ends 2*a* of the staple S2 are kept in a state where they face the paper surface 26, they are surely prevented from floating up from the paper surface 26. Also, since a unit for bending the staple S2 is not formed of a curved clinch groove but is formed of the guide inclined surfaces 12 or a combination of the guide inclined surfaces 12 and upper end face 16, even when the crown width varies, the leg portions 2 can be curved according to such variation, so that the expected binding operation is can be realized.

Here, as in the first exemplary embodiment shown in FIGS. 3 to 7, when the second clincher 6 is disposed at a position higher than the first clinchers 5, since the retreat operation of the first clinchers 5 and the upward movement of the second clincher 6 are carried out at a delicate timing, the parts of the clincher mechanism must be of high precision and also they must be assembled with high precision. On the other hand, when the second clincher 6 is disposed lower than the first clinchers 5, since there is room between the timing of the retreat operation of the first clinchers 5 and the timing of the upward movement of the second clincher 6, there is obtained an advantage that such high precision is not required in the parts and assembling operation thereof. However, in this case, the operation to curve the leg portions 2 of the stapler S2 cannot be guided by the upper end face 16 of the second clincher 6. Next, description will be given below of a second exemplary embodiment of the clincher mechanism of the present invention which can deal with this case.

Figure 8:
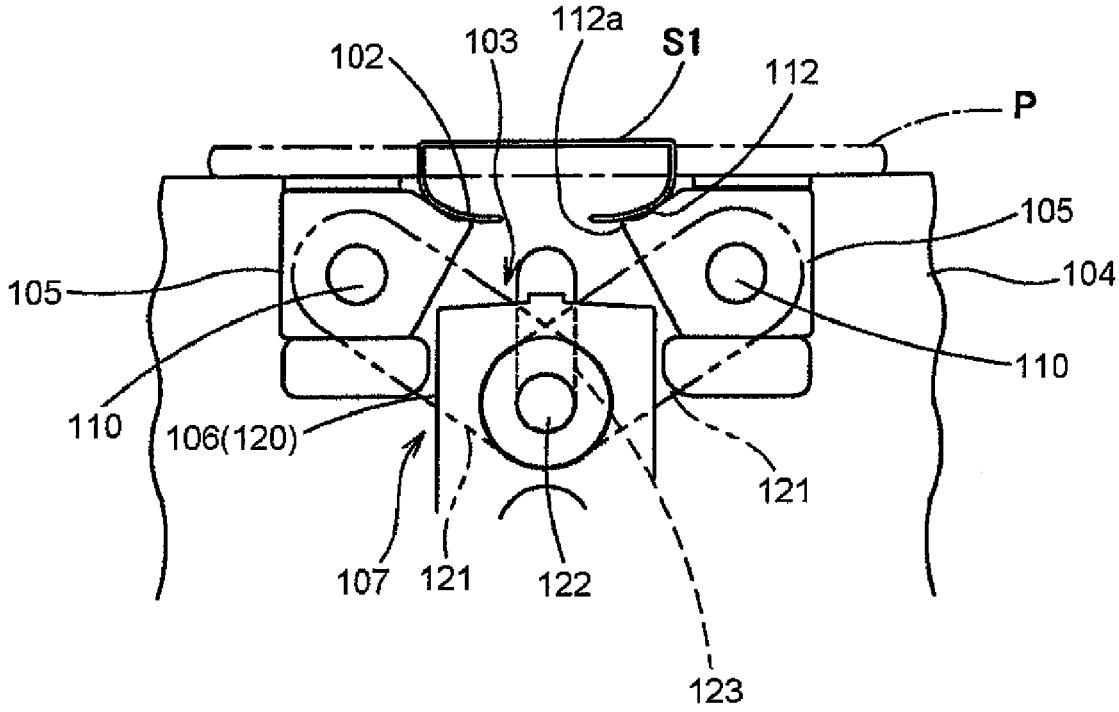
FIG. 8 is a front view of a clincher mechanism according to a second exemplary embodiment of the invention, showing an operation in which a staple having a large crown width is curved and bent using a clincher mechanism according to the second exemplary embodiment.

Now, description will be given below in detail of the second exemplary embodiment of the clincher mechanism of the present invention with reference to FIGS. 8 to 15. In FIG. 8, a lower end portion 112*a* of a guide inclined surface 112 of each of first clinchers 105 is formed such that it jumps up slightly and, similarly to the first exemplary embodiment, the first clinchers 105 can be slid right and left. Also, a second clincher 106 has the function of the drive link 120 as well, and an upper end face 116 is formed in such a manner that it descends toward two outer sides of a clincher mechanism 103 from a projection portion 115 which is provided on the central portion of the second clincher 106.

A drive mechanism 107, similarly to that shown in FIG. 2, includes the second clincher 106 and a pair of toggle links 121 having their respective one-side ends mounted pivotally on a support shaft 122 provided on the upper portion of the second clincher 106, while the other end portions of the two toggle links 121 are pivotally mounted on a shaft member 110 of each of the first clinchers 105. The support shaft 122 of the second clincher 106 is engaged with guide elongated holes 123 of plate-shaped holders 104 in such a manner that the support shaft 122 can be moved in the vertical direction along the guide elongated holes 123.

Next, description will be given below of the operation of the above-structured clincher mechanism 103 with reference to a staple S1 having a large crown width and a staple S2 having a small crown width.

Figure 9:
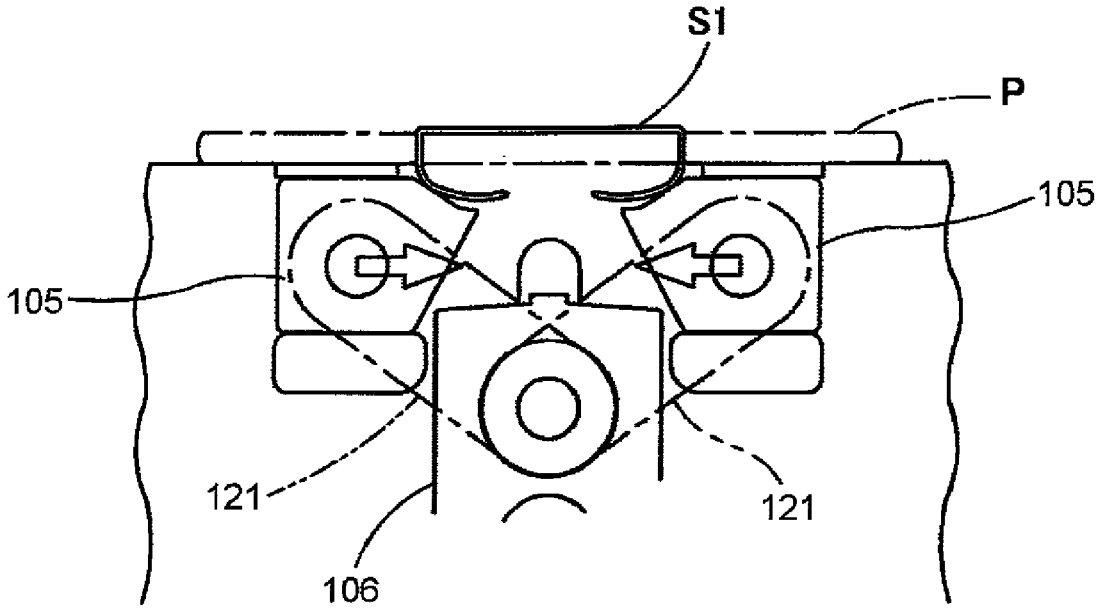
FIG. 9 is an explanatory view of the start state of the operation in which a curved staple is pressed and is thereby bent using the clincher mechanism according to the second exemplary embodiment.
Figure 10:
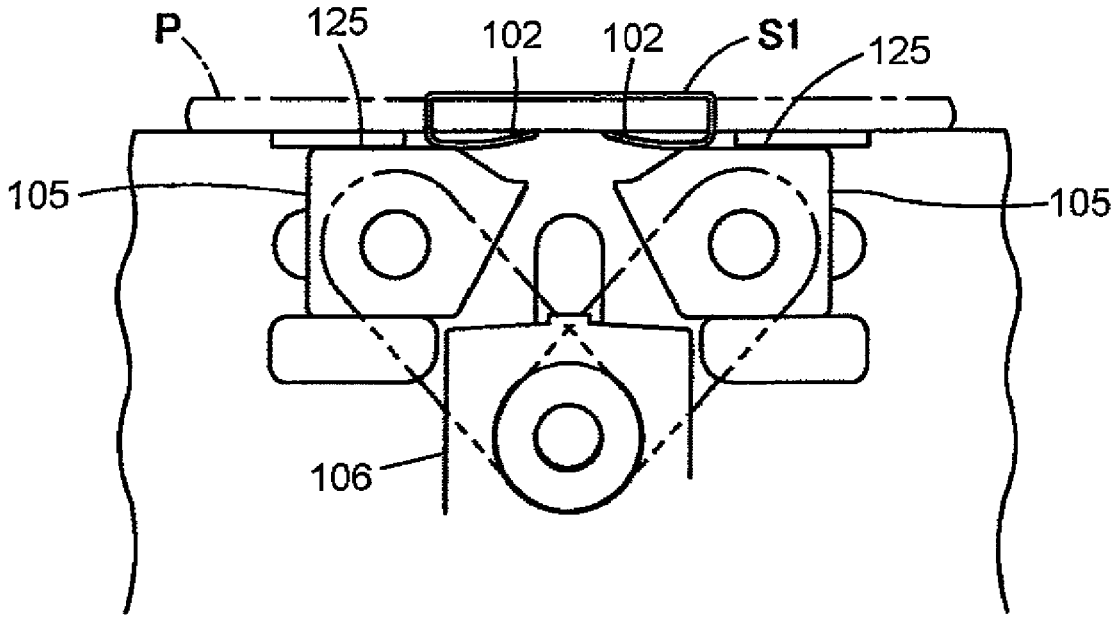
FIG. 10 is an explanatory view of a state where the drawing operation of the stapler is ended in the second exemplary embodiment.
Figure 11:
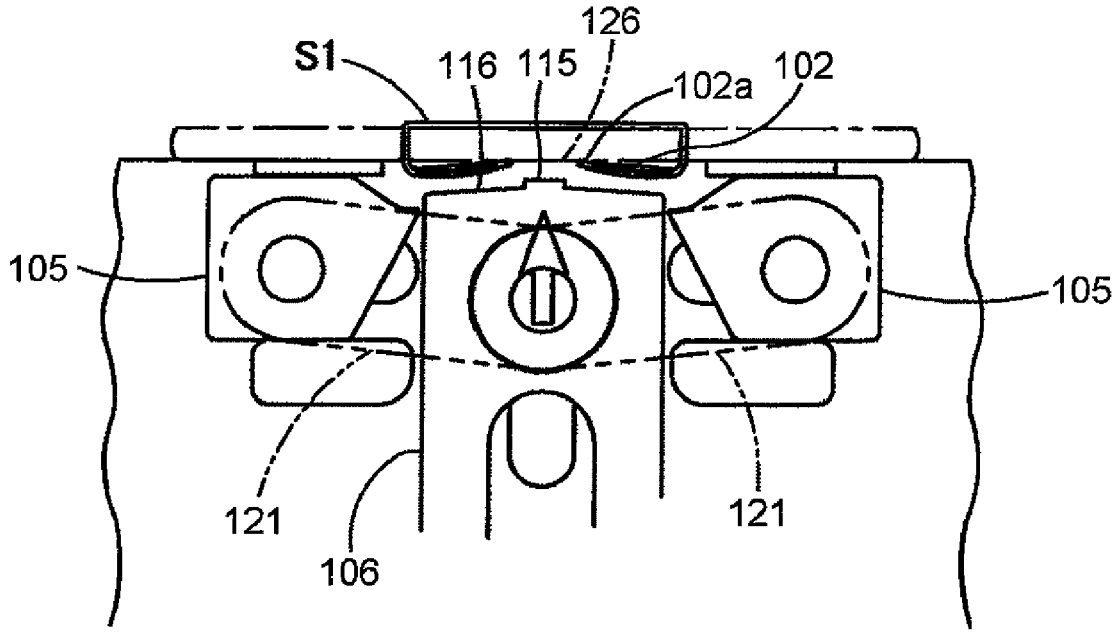
FIG. 11 is an explanatory view of a state where the second clincher of the clincher mechanism shown in FIG. 8 is operated.

Firstly, when striking the staple S1 having a large crown width into the central portion of the papers P put on the binding portion using the driver of the driving device, as shown in FIG. 8, the two leg portions 102 of the staple S1 are penetrated through the papers P, and the thus penetrated leg portions 102 are then butted against the guide inclined surfaces 112 of the first clinchers 105 and are thereby curved inwardly. When the driver reaches the bottom dead center, the drive mechanism 107 is operated to rotate the cam 30 shown in FIG. 2 and thus move down the lower roller 29, whereby, as shown in FIGS. 9 and 10, the second clincher 106 is moved slightly downwardly. As a result of this, the toggle links 121 are operated in their respective closing directions and thus the first clinchers 105 are moved in their mutually approaching directions; and, therefore, the two leg portions 102 of the staple S1 are pressed by upper end faces 125 of the first clinchers 105, whereby the two curved leg portions 102 are bent further. After then, as shown in FIG. 11, by moving the second clincher 106 upwardly, the toggle links 121 are spread outwardly to thereby allow the first clinchers 105 to move in their respective retreat directions where they part away from each other along the paper surface 126, so that the second clincher 106 is allowed to move upwardly toward the paper surface 126 from between the two first clinchers 105. In this case, the upper end face 116 of the second clincher 106 is engaged with the two leg portions 102 of the stapler S1 to press against the leg portions 102 toward the paper surface 126 and thereby bend them further; and further, the projection portion 115 presses against the leading ends 102*a* side of the two leg portions 102 toward the paper surface 126 of the papers P. As a result of this, the leading ends 102*a* of the two leg portions 102 of the staple S1 are crushed so that the leading ends 102*a* are firmly pressed against the paper surface 126.

Here, since the upper end face 116 of the second clincher 106 is formed such that it descends toward the two outer sides of the projection portion 115, there can be provided similar effects to those shown in FIG. 5.

Figure 12:
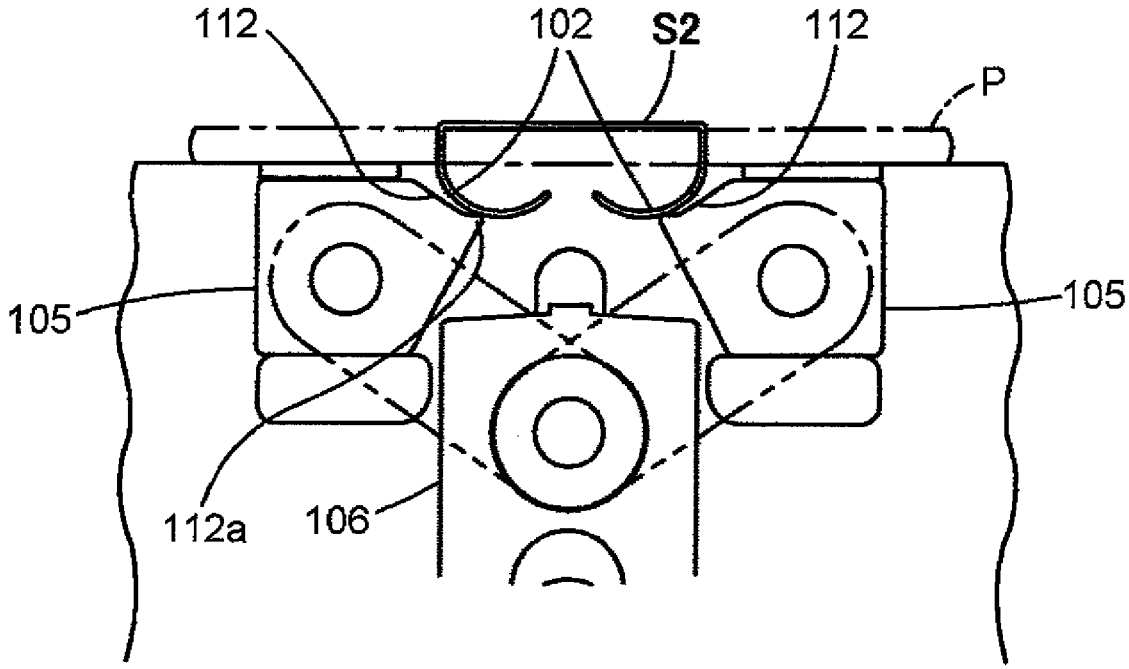
FIG. 12 is an explanatory view of a second clincher mechanism according to the second exemplary embodiment, showing an operation in which a staple having a small crown width is curved and bent using the second clincher mechanism according to the second exemplary embodiment.
Figure 13:
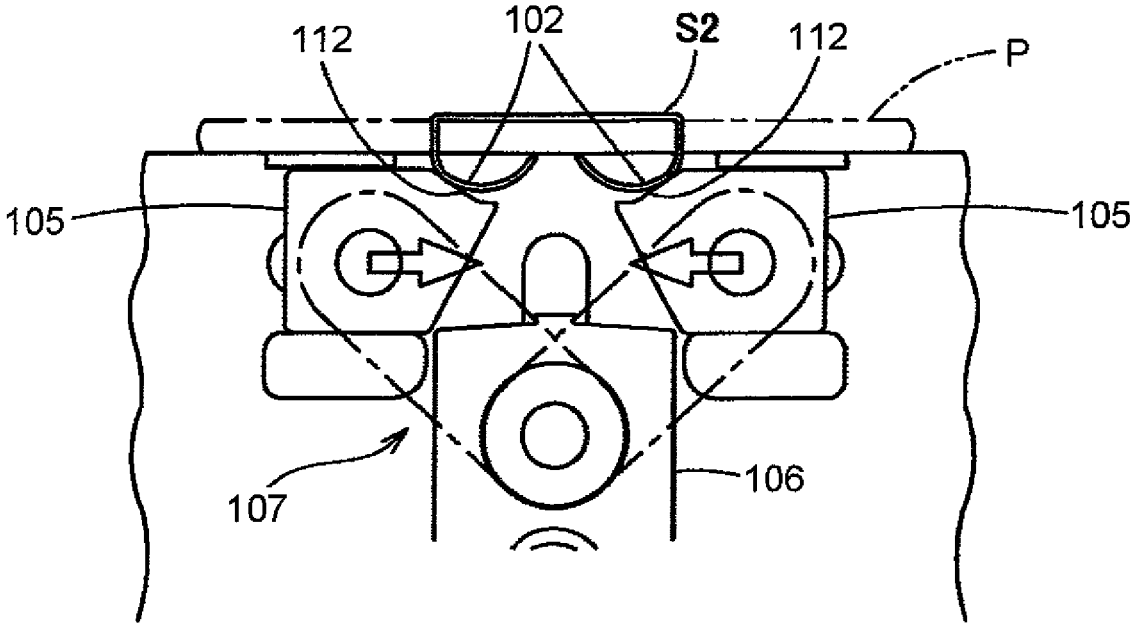
FIG. 13 is an explanatory view of the start state of the operation in which a curved staple is pressed and is thereby bent using the clincher mechanism in the second exemplary embodiment.
Figure 14:
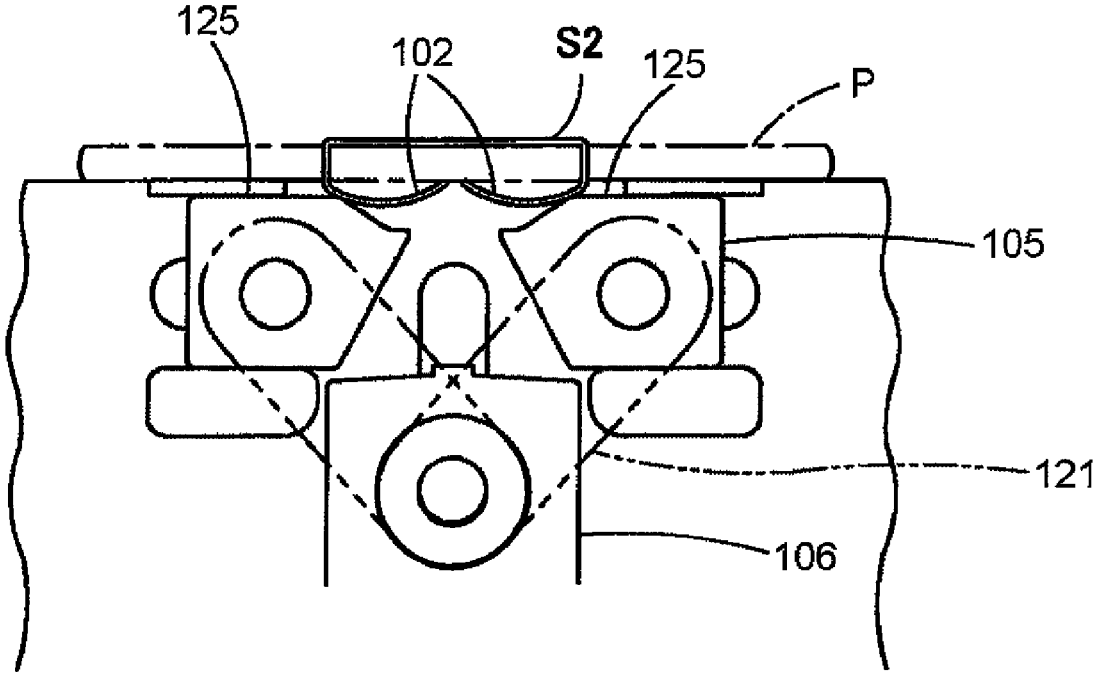
FIG. 14 is an explanatory view of a state where the drawing operation of the stapler is ended in the second exemplary embodiment.
Figure 15:
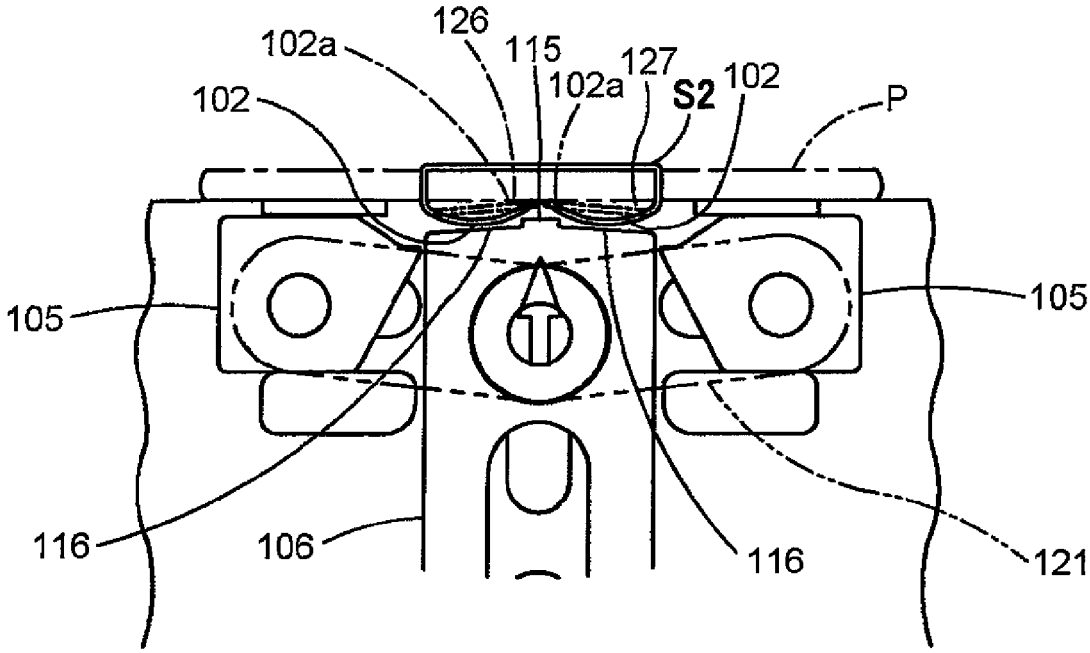
FIG. 15 is an explanatory view of a state where the second clincher of the clincher mechanism in the second exemplary embodiment is operated.

Next, referring to the operation of the staple S2 having a small crown width for binding, as shown in FIG. 12, when striking the staple S2 into the central portion of the papers P put on the binding portion using the driver of the driving device, the two leg portions 102 of the staple S2 are penetrated through the papers P, and the thus penetrated leg portions 102 are then butted against the guide inclined surfaces 112 of the first clinchers 105 and are thus curved inwardly. Since the lower end portions of the guide inclined surfaces 112 are formed such that they jump slightly, the leg portions 102 can be curved further positively. When the driver reaches the bottom dead center, as shown in FIGS. 13 and 14, the drive mechanism 107 is actuated to thereby move the second clincher 106 slightly downwardly. As a result of this, the toggle links 121 are operated in their mutually closing directions and the two first clinchers 105 are thereby moved in their mutually approaching directions; and, therefore, the two leg portions 102 of the staple S2 are pressed by the upper portions of the guide inclined surfaces 112 of the first clinchers 105 and are thereby bent. After then, as shown in FIG. 15, when the second clincher 106 is moved upwardly, the toggle links 121 are spread outwardly, whereby the first clinchers 105 are moved along the paper surface 126 in their respective retreat directions where the first clinchers 105 part away from each other and the second clincher 106 is moved upwardly from between the two first clinchers 105. In this case, the upper end face 116 of the second clincher 106 is engaged with the two leg portions 102 of the staple S2 to press against the leg portions 102 toward the paper surface 126 and bend them further; and further, the projection portion 115 presses against the leading ends 102*a* of the two leg portions 102 toward the paper surface 126 of the binding-receiving papers P. As a result of this, the leading ends 102*a* of the two leg portions 102 of the staple S2 are crushed and pressed against the paper surface 126 firmly.

In this case as well, since the upper end face 116 of the second clincher 106 is formed such that it descends toward the two outer sides of the projection portion 115, when the two leg portions 102 of the staple S2 are pressed using the second clincher 106, the two leg portions 102 are bent in such a manner that there can be formed spaces 127 between the turned portions of the base portions of the two leg portions 102, whereby only the leading ends 102*a* of the two leg portions 102 are pressed against the paper surface 126 in such a manner that the leading ends 102*a* cut into the paper surface 126.

According to the above clincher mechanism 103, the leading ends 102*a* of the two leg portions 102 of the curved staples S1 and S2 are firmly pressed against the paper surface 126 by the second clincher 106 and also the leading ends 102*a* are kept in a state where they face the paper surface 126, whereby the leading ends 102*a* are prevented from floating up from the paper surface 126. Also, since the unit for curving the staples S1 and S2 is made of not curved clinch grooves but the guide inclined surfaces 112, even when the crown width varies, the leg portions 102 can be curved correspondingly to such variation, thereby being able to realize an expected binding operation.

Here, the drive mechanism 107 is not limited to the above toggle mechanism but other types of mechanisms can also be used.

Also, since the guide inclined surfaces 112 of the first clinchers 105 are formed to have such size that can guide the leg portions 102 of at least two kinds of staples S1 and S2, at least two kinds of staples can be fastened positively.

Further, since the leading end face of the second clincher 106 facing the paper surface 126 is formed such that, with the above-mentioned projection portion 115 as the top portion thereof, it descends toward the two outer sides of the projection portion 115, when the upper end face 116 of the second clincher 106 is operated toward the paper surface 126, the projection portion 115 presses the leading ends 102*a* of the two curved leg portions 102 against the paper surface 126. As a result of this, the leading ends 102*a* of the two leg portions 102 of the staples S1 and S2 are crushed and thus pressed firmly against the paper surface 126.

Here, when the two leg portions 102 of the staples S1 and S2 are pressed with second clincher 106, if the leg portions 102 are pressed parallel to the paper surface 126, the staples S1 and S2 are made flat. However, since the upper end face 116 of the second clincher 106 is formed such that it descends toward the two outer sides of the projection portion 115, when the two leg portions 102 of the staples S1 and S2 are pressed with the second clincher 106, the force of the second clincher 106 acts in the outward direction, whereby the two leg portions 102 are bent in such a manner that there can be formed spaces 127 between the turned portions of the base portions of the two leg portions 102. Owing to this, only the leading ends 102*a* of the two leg portions 102 are pressed against the paper surface 126 in such a manner that the leading ends 102*a* cut into the paper surface 126, thereby being able to keep a state where the leading ends 102*a* face the paper surface 126. This can positively prevent the leading ends 102*a* of the two leg portions 102 from floating up from the paper surface 126.

Further, according to the second exemplary embodiment, since the first clinchers 105 are structured such that, before the retreating operation thereof, they move in their mutually approaching directions and press inwardly the base portions of the leg portions 102 of the staples S1 and S2 respectively curved by the guide inclined surfaces 112 to thereby bend the leg portions 102, there is eliminated the need that the upper end faces 116 of the second clincher 106 receive and curve further the respective leading ends 102*a* of the two leg portions 102 of the staple S1 and S2 curved by the guide inclined surfaces 112 of the first clinchers 105. Owing to this, since the position of the second clincher 106 can be set lower than the positions of the first clinchers 105, high precision is not required between the retreating movements of the first clinchers 105 and the upward movement of the second clincher 106, which can provide room for the dimensions of the parts and assembling of the parts.

Also, when the clincher mechanism 3 or 103 is disposed separately from the staples S1 and S2 driving unit, it is especially effective in binding together the papers P such as brochures like in-house bulletins or catalogs. However, of course, the clincher mechanism 3 or 103 can also be applied to a stapler structured such that the driving device A and binding device B are formed as an integral body.

Figure 16:
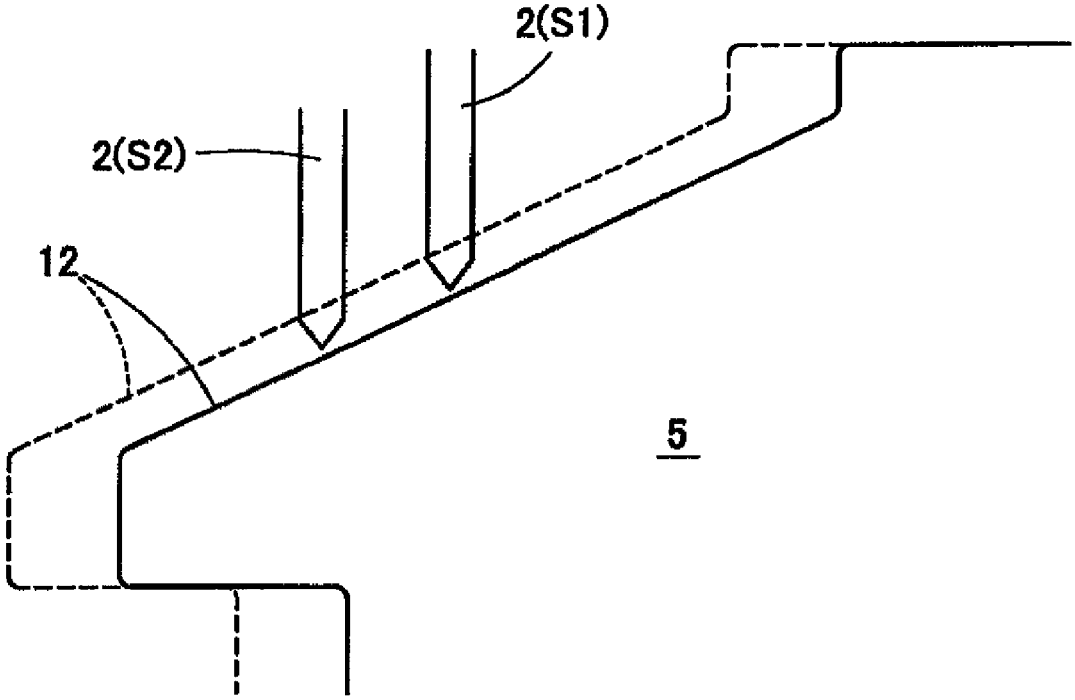
FIG. 16 is an explanatory view of the engagement relationship between first clinchers and the leg portions of staples.

Here, as shown in FIG. 16, since the staples S1 and S2 are different in crown width from each other, when the leading ends of the two leg portions 2 are contacted with the guide inclined surfaces 12 of the first clinchers 5, their respective contact positions are different from each other. Therefore, when the clincher mechanism 3 is set such that the leading ends of the leg portions 2 of the staple S1 having a large crown width are to be contacted with the central portions of the guide inclined surfaces 12, the leading ends of the leg portions 2 of the staple S2 having a small crown width are to be contacted with the portions of the guide inclined surfaces 12 that are situated inwardly of the central portions thereof. Similarly, when the clincher mechanism 3 is set such that the leading ends of the leg portions 2 of the staple S2 having a small crown width are to be contacted with the central portions of the guide inclined surfaces 12, the leading ends of the leg portions 2 of the staple S1 having a large crown width are to be contacted with the portions of the guide inclined surfaces 12 that are situated outwardly of the central portions thereof. In the binding operation, when the staple leg portions are driven to penetrate through the papers by the driver, they are inevitably shifted in position. Specifically, when the leading ends of the leg portions of the staple are shifted either inwardly or outwardly, there is a fear that the shifted staple leg portions cannot be contacted with the guide inclined surfaces. In this case, there is a fear that the staple can be clinched poorly or the staple can be bent in an undesirable shape, thereby being unable to carry out a desired clinching operation.

Therefore, preferably, whether the crown width is large or small, the leading ends of the leg portions 2 of the staples S1 and S2 may be contacted with the central portions of the guide inclined surfaces 12 of the first clinchers 5. For this purpose, by controlling the rotation of the electric motor, the angle of rotation of the cam 30 shown in FIG. 2 in the wait time thereof may be adjusted to thereby adjust the degree of spreading of the toggle links 21, that is, the wait positions of the first clinchers 5. In a case where the contact positions of the leading ends of the leg portions 2 of the staple S1 having a large crown width are set as the reference position, when the staple S1 is replaced with the staple S2 having a small crown width, the wait time rotation angle of the cam 30 may be adjusted to close the toggle links 21 slightly, whereby while, as shown by a dotted line in FIG. 16, the wait positions of the first clinchers 5 are moved slightly inwardly, the leading ends of the leg portions 2 of the staple S2 may be contacted with the substantially central portions of the guide inclined surfaces 12 of the first clinchers 5.

In order to adjust the wait positions of the first clinchers 5, there may be provided a detecting unit for detecting the crown width of a staple and an adjusting mechanism for adjusting the wait positions of the first clinchers 5 according to the detection results of the detecting unit.

Figure 17:
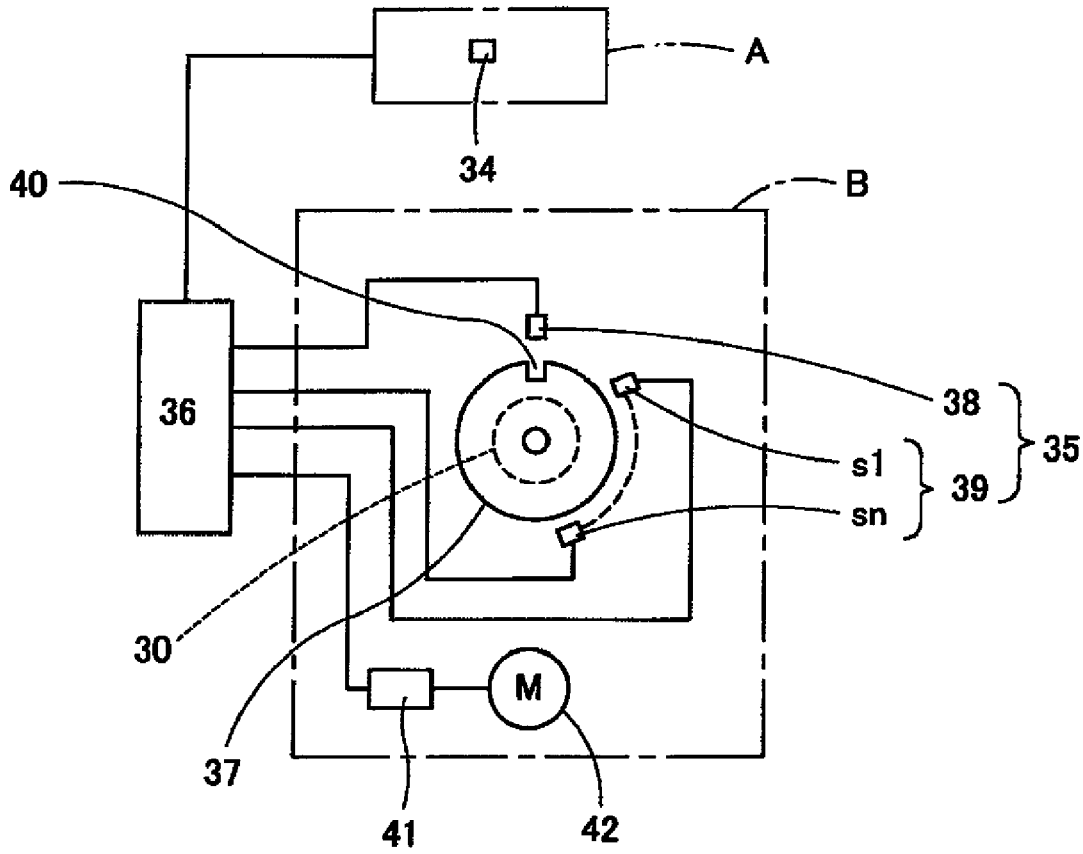
FIG. 17 is a block diagram of an adjusting mechanism for adjusting the positions of the first clinchers.

Such adjusting mechanism may be structured such that, for example, as shown in FIG. 17, it includes a first detecting unit 34 for detecting a crown width of a staple, a second detecting unit 35 for detecting the rotation position of the cam 30, and a control portion (microcomputer) 36 which recognizes the crown width according to the results of the first detecting unit 34 and stops the electric motor at a position where it determines from the result of the second detecting unit 35 that the cam 30 corresponds to the recognized crown width.

The first detecting unit 34 for detecting the crown width of a staple may be made of a sensor which is provided on the driving device A. Since the driving device A is structured such that a cartridge with staples stored therein can be mounted thereon and can be removed therefrom, and also since cartridges respectively storing therein staples having different crown widths are different in dimension from each other, the crown widths of the staples can be detected positively by the first detecting unit 34.

The second detecting unit 35 for detecting the position of the cam 30 may include a rotary plate 37 coaxial with the cam 30 constituting the clincher mechanism of the binding device B, a first sensor 38 disposed on the peripheral edge portion of the rotary plate 37 for detecting the start position of the rotary plate 37, and a second sensor 39 for detecting the rotation position of the cam 30 corresponding to the crown width of a staple. The second sensor 39 may be made of a photo sensor (of a transmission type or a reflection type). Multiple second sensors (s1 to sn) 39 may be arranged according to the sizes of the crown widths of the staples. And, each second sensor 39 may be structured such that, when detecting a slit (small hole) 40 formed in the peripheral edge portion of the rotary plate 37, it may send a detect signal to the control portion 36.

The control portion 36 may be structured in the following manner. That is, the control portion 36 rotates the rotary plate 37 together with the cam 30 and, at a stage where the first sensor 38 detects the start position, stops the rotation of an electric motor 42 to thereby initialize the cam 30. Next, the control portion 36 recognizes the crown width of the staple from the detection result of the first detecting unit 34, and rotates the rotary plate 37 again to check the detection result of the second sensor 39; and, when recognizing a detect signal from the second sensor 39 disposed at a position corresponding to the recognized crown width, the control portion 36 determines that the rotary plate 37 (cam) has arrived at a given position and thus controls a drive circuit 41 to thereby stop the electric motor 42.

While the present inventive concept has been shown and described with reference to certain exemplary embodiments thereof, it will be understood by those skilled in the art that various changes in form and details may be made therein without departing from the spirit and scope of the invention as defined by the appended claims.

What is claimed is:

1. A stapler clincher mechanism which bends two leg portions of a staple struck and penetrated through papers by a staple driving unit, comprising:

two first clinchers respectively disposed downwardly of the two leg portions of the staple and respectively including guide inclined surfaces which guides the two leg portions in such a manner that the two leg portions are curved inwardly;

a second clincher interposed between the two first clinchers and including a projection portion which presses leading ends of the two curved leg portions toward a paper surface of the papers; and a drive mechanism, after the two leg portions of the staple are curved by the guide inclined surfaces, which retreats the first clinchers along the paper surface and moves the second clincher toward the paper surface.

2. The stapler clincher mechanism according to claim 1, wherein the guide inclined surfaces of the first clinchers are formed to have such a size as allows the guide inclined surfaces to be engaged with the leading ends of the leg portions of at least two kinds of staples differing in crown width from each other.

3. The stapler clincher mechanism according to claim 1, further comprising:

detecting unit which detects a crown width of the staple; and adjusting unit which adjusts wait positions of the first clinchers according to a detection result of the detecting unit.

4. The stapler clincher mechanism according to claim 3, wherein the adjusting unit adjusts the wait positions of the first clinchers in such a manner that the leading ends of the leg portions of the staple are contacted with central portions of the guide inclined surfaces of the first clinchers.

5. The stapler clincher mechanism according to claim 1, wherein a leading end face of the second clincher facing the paper surface is formed such that, with the projection portion provided in a central portion of the leading end face of the second clincher as the highest position thereof, the leading end face descends outwardly on both outer sides of the projection portion, and the leading end face presses the leg portions of the staple toward the paper surface.

6. The stapler clincher mechanism according to claim 1, wherein the leading end faces of the second clincher on both sides of the projection portion receive the leading ends of the two leg portions of the staple curved by the guide inclined surfaces of the first clinchers and guide the leading ends of the leg portions in such a manner that the leading ends are curved further.

7. The stapler clincher mechanism according to claim 1, wherein the first clinchers, before the first clinchers retreat, move in their mutually approaching directions and press inwardly base portions of the two leg portions of the staple to thereby facilitate the curving operation of the two leg portions.

8. The stapler clincher mechanism according to claim 1, wherein the clincher mechanism is provided separately from the staple driving unit.

* * * * *